US005588450A

United States Patent [19]

Gueret

[11] Patent Number: 5,588,450

[45] Date of Patent: Dec. 31, 1996

[54] BRUSH FOR APPLYING A MAKE-UP PRODUCT, PARTICULARLY MASCARA

[75] Inventor: Jean-Louis H. Gueret, Paris, France

[73] Assignee: L'Oreal, Paris, France

[21] Appl. No.: 387,802

[22] PCT Filed: Jun. 17, 1994

[86] PCT No.: PCT/FR94/00729

§ 371 Date: Feb. 21, 1995

§ 102(e) Date: Feb. 21, 1995

[87] PCT Pub. No.: WO95/00050

PCT Pub. Date: Jan. 5, 1995

[30] Foreign Application Priority Data

Jun. 23, 1993 [FR] France ..... 93 07609

[51] Int. Cl.[6] ..... A45D 40/26

[52] U.S. Cl. ..... 132/218; 132/216; 132/320; 132/317; 132/318; 15/206; 15/207.2

[58] Field of Search ..... 132/216, 218, 132/317, 318, 319, 320; 401/118, 122, 128, 129; 15/206, 207, 207.2

[56] References Cited

U.S. PATENT DOCUMENTS

| | | | |
|---|---|---|---|
| 3,121,040 | 2/1964 | Shaw et al. . | |
| 4,307,478 | 12/1981 | Ward et al. . | |
| 4,617,948 | 10/1986 | Gueret | 132/218 |
| 4,705,053 | 11/1987 | Goucalves | 401/129 |
| 4,887,622 | 12/1989 | Gueret . | |
| 4,927,281 | 5/1990 | Gueret | 132/218 |
| 4,958,402 | 9/1990 | Weihrauch | 15/207.2 |
| 4,961,665 | 10/1990 | Sitter | 401/129 |
| 4,974,612 | 12/1990 | Gueret . | |
| 5,020,551 | 6/1991 | Guerret . | |
| 5,063,947 | 11/1991 | Gueret | 132/218 |

FOREIGN PATENT DOCUMENTS

| | | |
|---|---|---|
| 0250680 | 1/1988 | European Pat. Off. . |
| 0329505 | 8/1989 | European Pat. Off. . |
| 2607373 | 6/1988 | France . |
| 2627363 | 8/1989 | France . |
| 2637471 | 4/1990 | France . |

*Primary Examiner*—Gene Mancene
*Assistant Examiner*—Pedro Philogene
*Attorney, Agent, or Firm*—Young & Thompson

[57] ABSTRACT

A brush for applying make-up, particularly mascara, including a shaft provided at one end with a core (6) formed by two metal wires (7, 8) twisted together and having bristles (9) squeezed therebetween such that they extend transversely to the core axis. At least some of the brush bristles (9) have an L-shaped cross-section so that the portion of each bristle (9) which is squeezed between said twisted core wires is flattened either outwards when the arms of the L are pushed apart, or inwards when they are pressed together. In either case, the stiffness of the bristle is reduced and the spacing between the bristle and a wire helix formed after twisting is advantageously increased, whereby a random distribution of bristle cross-sections is achieved.

2 Claims, 2 Drawing Sheets

BRUSH FOR APPLYING A MAKE-UP PRODUCT, PARTICULARLY MASCARA

FIELD OF THE INVENTION

The invention relates to a brush for applying a make-up product, particularly mascara, of that type which comprises a wand equipped at one end with a core formed by two branches made from metal wire which are twisted into turns between which bristles extending transversely with respect to the core are trapped.

BACKGROUND OF THE INVENTION

Such brushes are used, in particular, for applying mascara to the eyelashes or dye to the hair.

FR-A-2,607,373 shows a brush of this type, a variant embodiment of which includes bristles having a cruciform cross-section. Four reserves of make-up product are thus constituted along each bristle. At the time of application, the reserves of product are progressively emptied and lead to a homogeneous and thick coating of the eyelashes.

Although permitting an improvement in making-up, such a brush has a certain overall hardness which may sometimes lead to irritation of the skin of the eyelids. The symmetry of the transverse section of the bristle, with respect to the center of this section, gives rise to virtually identical behaviour on the part of all the bristles when they are squashed in the zone of twisting of the metal core so that the ends of the bristles reproduce the spiral effect created by the twisted core.

U.S. Pat. No. 3,121,040 relates to filaments made from polyolefins which are used in different types of brush. Various sectional shapes, presented as equivalents, are proposed for improving the resistance of the filaments to deformation. Amongst these sectional shapes is a V-shaped section or a substantially L-shaped section, with no other particular indication which might lead to this shape being adopted in preference to the others.

SUMMARY OF THE INVENTION

Above all, the object of the invention is to provide a brush for applying a make-up product which has great flexibility but is capable of achieving extremely good coverage by virtue of a significant charge of product taken up. Moreover, it is desirable for the spiral effect to be reduced at the ends of the bristles.

According to the invention, a brush for applying a make-up product, particularly mascara, of the type defined above, is characterized in that at least a fraction of the bristles of the brush has a transverse section in the shape of an L, which is known per se, so that the zone of a bristle wedged between the turns of the metal core undergoes a flattening either through the effect of unfolding when the angle between the branches of the L opens or through the effect of folding when the angle between the branches of the L closes, this flattening reducing the rigidity of the bristle on the one hand and, on the other hand, preferentially increasing the spacing of the bristle with respect to the helical ply formed by the turn, thus creating a disorganized arrangement of the section of the bristles. Thus, the angle formed between the axis of the metal core and the bristle is substantially other than 90°.

Preferably, the branches of the transverse section in the shape of an L of the bristles have the same length. Advantageously, the branches of the L together form an angle of approximately 90°.

The span of the transverse section in the shape of an L of a bristle in the non-deformed state is preferably between 10 one hundredths and 50 one hundredths of a millimetre.

The thickness of each branch of the section of a bristle is advantageously approximately 0.04 mm.

The ends of at least a portion of the bristles may be shredded, particularly by grinding.

The bristles having a transverse section in the shape of an L may be mixed with other types of bristles, for example bristles having a substantially flat transverse section or bristles of greater hardness. In the latter case, all the bristles having a transverse section in the shape of an L and harder bristles may be subjected to a grinding operation so as to obtain bristles having a transverse section in the shape of an L in which the ends are located beyond those of the hard bristles made shorter by grinding.

The ends of the bristles having a transverse section in the shape of an L may be exposed to a source of heat so as to present a swelling. The bristles having a transverse section in the shape of an L may be mixed with bristles of smaller section, the whole assembly then being exposed to the source of heat, exposure to the heat giving rise to a shortening of the bristles with a small section which is greater than that of the bristles having a section in the shape of an L in which the ends project beyond those of the bristles of smaller section.

The number of bristles in the shape of an L per turn may be small, of the order of 7 to 40 bristles per turn.

BRIEF DESCRIPTION OF THE DRAWINGS

Apart from the arrangements set forth above, the invention consists of a certain number of other arrangements which will be discussed in more detail hereinafter by way of illustrative embodiments described with reference to the appended drawings, these embodiments in no way being limiting in character.

DETAILED DESCRIPTION OF THE INVENTION

Figure 1:
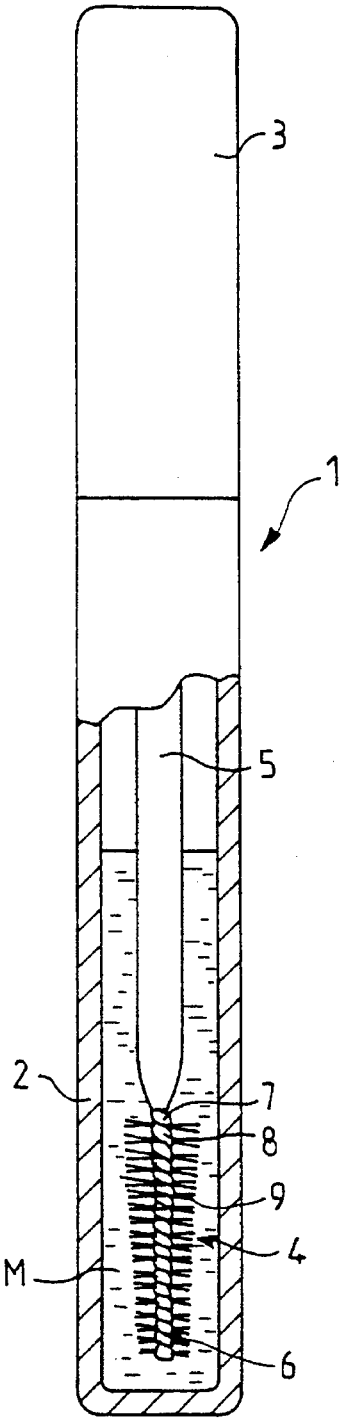
FIG. 1 of these drawings is an outside view, with parts cut away, of a reservoir of mascara including a brush for applying the product.

With reference to FIG. 1 of the drawing, it is possible to see an applicator assembly 1 comprising a reservoir 2 which contains a mascara M of liquid to pasty consistency. The reservoir 2 is surmounted by a cap 3 integral with a brush 4 for applying the mascara M, particularly to the eyelashes.

The brush 4 comprises a wand 5 equipped at its lower end with a core 6 formed by two branches 7, 8 made from metal wire which are twisted into turns between which bristles 9 extending transversely with respect to the core 6 are trapped.

Figure 2:
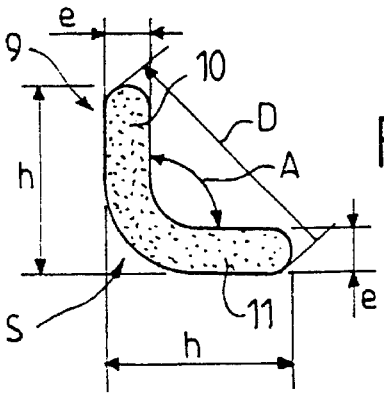
FIG. 2 is a transverse section on a larger scale of a bristle for a brush in accordance with the invention.

At least a fraction of the bristles 9 of the brush has a transverse section S (see FIG. 2) in the shape of an L including two branches 10, 11 together forming an angle A. The vertex of the angle is rounded. Preferably, the branches 10, 11 of the section have the same length h. The angle A has a value of substantially 90°.

The span D of the transverse section S, that is to say the diagonal distance between the ends of the branches, is preferably between 10 one hundredths and 50 one hundredths of a millimeter, the limits of this gap being inclusive. The thickness e of each branch is advantageously 0.04 mm.

In order to manufacture the brush in a conventional manner, the bristles 9 are distributed in bunches, arranged transversely, between the branches 7, 8 which are parallel before being twisted.

Figure 3:
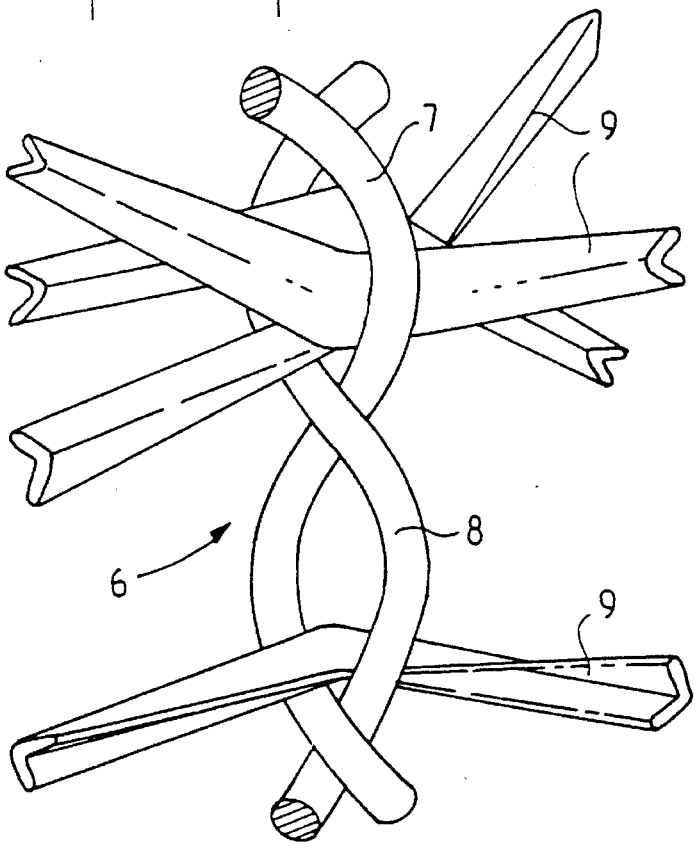
FIG. 3 is a partial perspective, diagrammatic view on a large scale of turns of the core during formation with wedging of the bristles between these turns.
Figure 4:
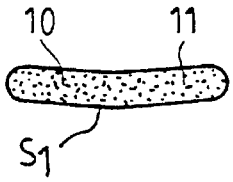
FIG. 4 is a transverse section on a large scale of a section, flattened by wedging between the turns, of a bristle in the shape of an L in which the angle between the branches is open.
Figure 5:
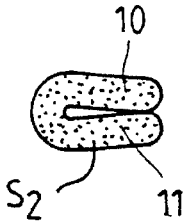
FIG. 5 is a transverse section on a large scale of the zone of a bristle wedged between the turns which has undergone folding.

During twisting, which is commenced in FIG. 3, a zone of each bristle 9 is wedged between the turns of the metal core. In the zone of the bristle which is wedged between these turns, the transverse section S will be flattened either by opening the angle A as illustrated in FIG. 4, to give the section S1, or by closing angle A after a folding, to give the section S2 in FIG. 5.

Although their transverse section S has a square shape, the bristles 9, when they have been gripped by twisting in the turns of the core 6, lose their rigidity owing to being flattened in the zone where they are clamped in the turns of the core and which zone constitutes their base. In fact, the moments of inertia of the section S1 and of the section S2 are lower than the moment of inertia of the starting section in the shape of an L illustrated in FIG. 2. However, the bristle whose section is flattened to become S2 has a double thickness and is more rigid than the bristle whose section is flattened into S1. Thus, while reducing the rigidity of the bristles relative to a bristle having a section in the shape of an L over its entire length, a mixture of flexible bristles having a section S1 in the shape of a flattened open V and of less flexible (or more rigid) bristles obtained by flattening the closed V into S2, as a double thickness, is created along the entire length of the brush.

By providing a wide span D and a small thickness e, it is possible to obtain a particularly soft brush which prevents any irritation but which ensures very rapid making-up and good coverage, since the bristles 9 are loaded with a large amount of product in the concavity of their section.

Figure 10:
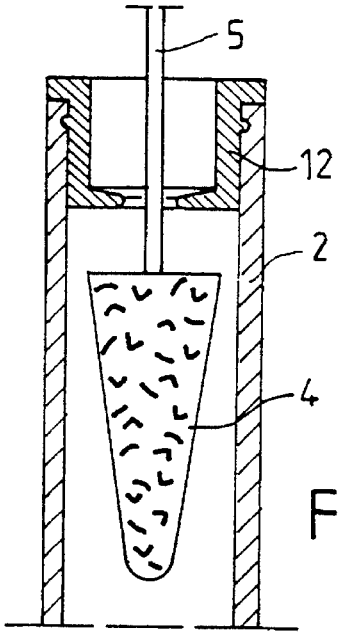
FIG. 10 is a partial section of a container equipped with a dryer and with a brush according to the invention.
Figure 11:
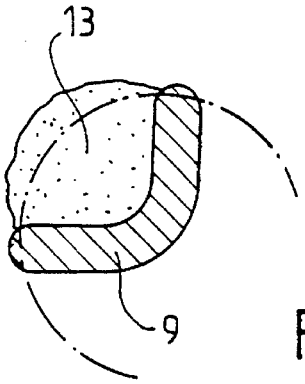
FIG. 11, finally, is a diagram illustrating removal of a load of product with a bristle according to the invention.

The reservoir 2 is equipped, at the top, with a dryer 12 (see FIG. 10) including a reservoir of small diameter which is intended to be traversed by the bristles 9 during removal so as to dry off the excess product. As illustrated in FIG. 11, the bristles 9 remain laden with product in the zone 13 located inside the section in the shape of an L. Opening of the section of the bristles to approximately 90° ensures that a large amount of product is taken up, in the manner of a shovel, whilst still protecting this load, in the zone 13, against excessive drying off.

The bristles 9 are dried off according to the variable orientation of their ends, which gives rise to a brush having variable drying-off.

The large load of product on the bristles makes it possible to achieve extremely good coverage while still having a brush with great flexibility.

When they are clamped between the twisted branches 7, 8 of the core, the bristles 9 preferentially fold according to the diagram in FIG. 4, that is to say according to an unfolding effect with opening of the angle between the branches.

Figure 6:
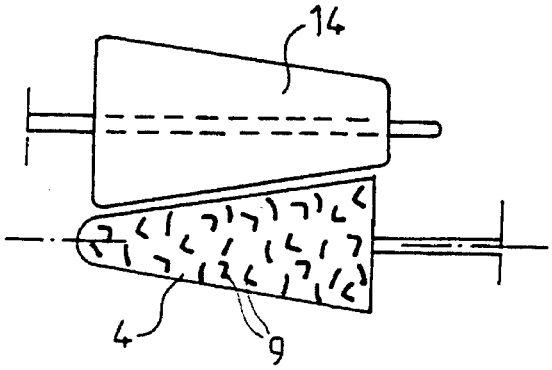
FIG. 6 diagrammatically illustrates an operation of grinding and shaping a brush according to the invention.

The transverse section in the shape of an L of the bristles is asymmetrical with respect to the vertex of this section so that the deformations created by clamping between the turns gives a random distribution in terms of the orientation of the portions of the bristles extending from the core. The brush thus produced is tufted and the ends of the bristles distributed randomly (as shown diagrammatically in FIGS. 6, 8 and 10) reduce the spiral effect usually created on conventional mascara brushes by the twisted core.

The core 6 of the brush is not necessarily central and may be off-center.

The brush 4 may be shaped by a grinder 14 (see FIG. 6) which is, for example, frustoconical, the axis of which is arranged parallel to that of the core 6 of the brush. Generally, for the grinding operation, the brush 4 is made to turn about the axis of the core and of the wand 5 and the grinder 14 is made to turn about its axis, preferably in a direction opposite to the direction of rotation of the brush. Generally, it is possible to give the brush 4 the desired shape by using a grinder 14 of complementary shape.

Figure 7:
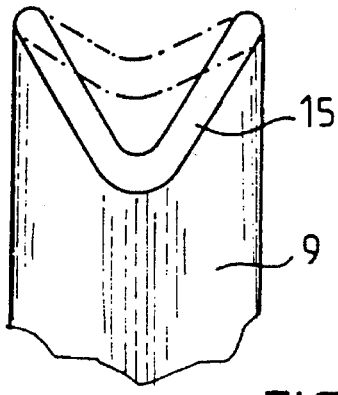
FIG. 7 shows on a large scale the end of a bristle which has been ground.

Grinding of the bristles 9 of the brush may also be carried out without modification of the overall shape of the brush 4. Grinding produces torn ends on the bristles 9 which have the form of forks 15 (FIG. 7) substantially corresponding to the section of a right-angled dihedron through a plane which is inclined with respect to the edge of the dihedron.

It should be noted that the bristles 9 having a transverse section in the shape of an L may be mixed with bristles of greater hardness. During a grinding operation, the bristles 9 having a section in the shape of an L will be worn away less than the harder bristles and, after grinding, the bristles 9 having a section in the shape of an L will have their ends located beyond those of the harder bristles. The harder bristles may be cylindrical bristles having a circular section or flat bristles or bristles having a section in the shape of a horseshoe.

Figure 8:
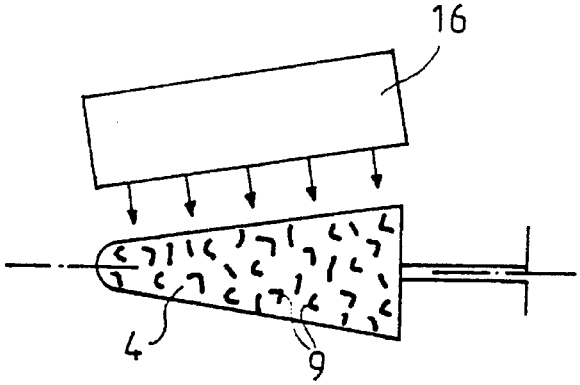
FIG. 8 diagrammatically illustrates an exposure of the brush to a source of heat.
Figure 9:
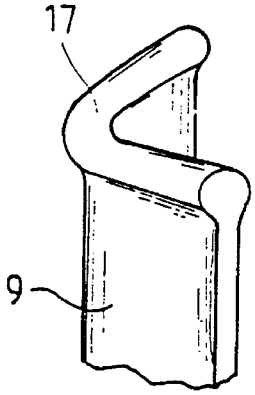
FIG. 9 is a perspective view on a large scale of the end of a bristle which has been exposed to heat.

As illustrated in FIG. 8, the brush 4 may be exposed to a source of heat 16, for example an infrared radiation array placed substantially parallel to a generatrix of the brush 4. Preferably, the brush 4 is made to turn about its axis in front of this source of heat 16. The temperature of the source 16 is chosen so that the ends of the bristles 9 begin to melt, giving rise to an inflation 17 in the shape of an L, as may be seen in FIG. 9, which extends along the entire transverse border of the bristle.

The bristles 9 having a section in the shape of an L may be mixed with bristles of smaller section and then exposed to the source of heat 16. During heat treatment, the bristles of smaller section, which are less resistant to the heat, will suffer a reduction in length greater than that of the bristles having a section in the shape of an L in which the inflated ends 17 will remain projecting beyond the ends of the bristles of smaller section.

The bristles having a section in the shape of an L may be mixed with bristles having a flat transverse section, particularly with bristles in which the substantially rectangular section has a major dimension which is at least equal to double the minor dimension and no more than five times as large as this minor dimension, as stipulated in FR-B-2,627,363.

The bristles having a transverse section in the shape of an L are preferably obtained by extrusion through a suitable die. These bristles may be produced from polyamide plastic PA6-66; 6-10; 6-12 or from PA11 (commercial name RILSAN), or from polyethylene, from a thermoplastic elastomer such as polyurethane, or from block polyetheramide.

The brushes produced with the bristles having a section in the shape of an L, according to the invention, may include a small number of bristles per turn, for example 7 to 40 bristles per turn.

The metal wires, in particularly the iron wires, which are used for branches 7, 8 of the core may be very fine, with a diameter advantageously between 5 tenths and 10 tenths of a millimeter, since the bristles 9 having a transverse section in the shape of an L are squashed between the turns.

I claim:

1. Brush for applying a make-up product, comprising a wand equipped at one end with a core formed by two branches made from metal wire which are twisted into turns between which bristles extending transversely with respect to the core are trapped, wherein at least a fraction of the bristles of the brush has a transverse section in the shape of an L so that a zone of a bristle wedged between the turns of the core undergoes a flattening by the effect of one of unfolding when an angle between the branches of the L opens, and folding when the angle between the branches of the L closes, said flattening reducing the rigidity of the bristle and increasing the spacing between the bristle and a helical ply formed after twisting, thereby creating a disorganized arrangement of the section of the bristles, said bristles having a transverse section in the shape of an L being mixed with harder bristles so as to form an assembly, and said assembly being ground in order to obtain bristles having a transverse section in the shape of an L and whose ends are located beyond those of the harder bristles made shorter by grinding.

2. Brush for applying a make-up product, comprising a wand equipped at one end with a core formed by two branches made from metal wire which are twisted into turns between which bristles extending transversely with respect to the core are trapped, wherein at least a fraction of the bristles of the brush has a transverse section in the shape of an L so that a zone of a bristle wedged between the turns of the core undergoes a flattening by the effect of one of unfolding when an angle between the branches of the L opens, and folding when the angle between the branches of the L closes, said flattening reducing the rigidity of the bristle and increasing the spacing between the bristle and a helical ply formed after twisting, thereby creating a disorganized arrangement of the section of the bristles, said bristles having a transverse section in the shape of an L being mixed with bristles of smaller section so as to form an assembly, said assembly then being exposed to a source of heat, exposure to the heat giving rise to a shortening of the bristles of the shorter section, which is greater than that of the bristles having a section in the shape of an L, whose ends project beyond those of the bristles of smaller section.

* * * * *